US005355864A

United States Patent [19]

Kuroda et al.

[11] Patent Number: 5,355,864

[45] Date of Patent: Oct. 18, 1994

[54] EVAPORATIVE FUEL-PROCESSING SYSTEM FOR INTERNAL COMBUSTION ENGINES

[75] Inventors: Shigetaka Kuroda; Kazutomo Sawamura; Hiroshi Maruyama; Masayoshi Yamanaka; Yoichi Iwata; Tsuyoshi Takizawa, all of Wako, Japan

[73] Assignee: Honda Giken Kogyo Kabushiki Kaisha, Tokyo, Japan

[21] Appl. No.: 173,055

[22] Filed: Dec. 27, 1993

Related U.S. Application Data

[63] Continuation of Ser. No. 5,802, Jan. 19, 1993, abandoned.

[30] Foreign Application Priority Data

Jan. 20, 1992 [JP] Japan ..... 4-028861
Jan. 20, 1992 [JP] Japan ..... 4-028862
Jan. 20, 1992 [JP] Japan ..... 4-028863

[51] Int. Cl.[5] ..... F02M 33/02
[52] U.S. Cl. ..... 123/520; 123/198 D
[58] Field of Search ..... 123/516, 518, 519, 520, 123/198 D

[56] References Cited

U.S. PATENT DOCUMENTS 4,862,856 9/1989 Yokoe et al. ..... 123/519
4,926,825 5/1990 Ohtaka et al. ..... 123/520
4,949,695 8/1990 Uranishi et al. ..... 123/520
5,054,454 10/1991 Hamburg ..... 123/520
5,080,078 1/1992 Hamburg ..... 123/519
5,111,796 5/1992 Ogita ..... 123/518
5,139,001 8/1992 Tada ..... 123/520
5,143,035 9/1992 Kayanuma ..... 123/198 D
5,146,902 9/1992 Cook et al. ..... 123/198 D
5,158,054 10/1992 Otsuka ..... 123/198 D
5,190,014 3/1993 Suga et al. ..... 123/1 A
5,193,512 3/1993 Steinbrenner et al. ..... 123/520
5,195,498 3/1993 Siebler et al. ..... 123/520
5,197,442 3/1993 Blumenstock et al. ..... 123/520
5,205,263 4/1993 Blumenstock et al. ..... 123/518
5,267,547 12/1993 Chikamatsu et al. ..... 123/198 D
5,269,277 12/1993 Kuroda et al. ..... 123/198 D
5,299,545 4/1994 Kuroda et al. ..... 123/198 D

*Primary Examiner*—E. Rollins Cross
*Assistant Examiner*—Thomas N. Moulis
*Attorney, Agent, or Firm*—Nikaido, Marmelstein, Murray & Oram

[57] ABSTRACT

An evaporative fuel-processing system for an internal combustion engine, in which a first control valve is arranged across an evaporative fuel-guiding passage extending from a fuel tank to a canister, a second control valve across a purging passage extending from the canister to the intake system of the engine, and a third control valve at an air inlet port of the canister, respectively. An ECU generates operation command signals to the first to third control valves for closing or opening the same. The ECU is responsive to an output from a tank internal pressure sensor which detects pressure within the fuel tank and the operation command signals, for detecting an abnormality in operation of a predetermined one of the first to third control valves.

12 Claims, 9 Drawing Sheets

EVAPORATIVE FUEL-PROCESSING SYSTEM FOR INTERNAL COMBUSTION ENGINES

This application is a continuation of application Ser. No. 08/005,802, filed Jan. 19, 1993, now abandoned.

BACKGROUND OF THE INVENTION

1. Field of the Invention

This invention relates to an evaporative fuel-processing system for internal combustion engines, and more particularly to an evaporative fuel-processing system which has a function of detecting abnormalities in control valves provided in an evaporative emission control system of the engine.

2. Prior Art

Conventionally, there has been widely used an evaporative fuel-processing system for internal combustion engines, which comprises a canister having an air inlet port provided therein, a first control valve arranged across an evaporative fuel-guiding passage extending from a fuel tank of the engine to the canister, and a second control valve arranged across a purging passage extending from the canister to an intake system of the engine.

A system of this kind temporarily stores evaporative fuel in the canister, and then purges the evaporative fuel into the intake system of the engine.

Whether a system of this kind is normally operating can be checked, for example, by bringing the evaporative emission control system into a predetermined negatively pressurized state, measuring a change in the pressure within the fuel tank (tank internal pressure) with the lapse of time after the evaporating emission control system has been brought into the predetermined negatively pressurized state, and determining whether the system is normally operating, from the measured tank internal pressure, as proposed by U.S. Ser. No. 07/942,875 assigned to the assignee of the present application.

According to the method of the earlier application, a third control valve is provided at the air inlet port of the canister, for closing and opening the same. To detect an abnormality in the evaporative emission control system, the third control valve is kept closed and the first and second control valves are kept open while the engine is operating so that the interior of the evaporative emission control system is brought into the predetermined negatively pressurized state. Then, the second control valve is closed, followed by measuring a change in the tank internal pressure by means of a tank internal pressure sensor arranged at a suitable location in the fuel tank, and it is determined from the measured change in the tank internal pressure whether evaporative fuel has leaked to the outside through the evaporative emission control system (Leak Down Check) to thereby determine an abnormality in the evaporative fuel-processing system.

In the evaporative emission control system, while the third control valve is kept closed during the abnormality determination, it is kept open during normal purging to allow fresh air to be introduced into the canister through the air inlet port so that evaporative fuel temporarily stored in the canister is purged through the purging passage into the intake system of the engine.

To determine an abnormality in the evaporative fuel-processing system more accurately, it is desirable to measure an amount of change in the tank internal pressure with the lapse of time immediately after the interior of the fuel tank is made open to the atmosphere, and determine the presence of an abnormality by comparing between the measured amount of change and an amount of change in the tank internal pressure measured during the leak down check. That is, if a hole or the like is formed in the fuel tank, the interior of the evaporative emission control system cannot be negatively pressurized into the predetermined negatively pressurized state for carrying out accurate abnormality determination through the leak down check. Further, if evaporative fuel is generated in large quantities in the fuel tank, there occurs a large amount of change in the tank internal pressure during the leak down check. Consequently, an erroneous decision can be rendered that the system is abnormal, due to such a large amount of change in the tank internal pressure. Therefore, desirably, the abnormality determination should be made based upon both an amount of change in the tank internal pressure measured immediately after the interior of the fuel tank is made open to the atmosphere and one measured during the leak down check.

However, the above proposed abnormality determining method makes it a precondition to close the first control valve. Therefore, when the first control valve is defective, the abnormality determination cannot be made accurately. That is, when the first control valve is kept closed due to a fault, it is impossible to detect an amount of change in the tank internal pressure during the leak down check. As a result, the interior of the canister can be excessively negatively pressured.

Also when the first control valve is kept open due to a fault, it is impossible to detect an amount of change in the tank internal pressure occurring after the interior of the tank is made open to the atmosphere, so that accurate abnormality determination cannot be achieved.

Further, according to the earlier application, the leak down check is carried out after the second control valve is changed from an open state to a closed state. Therefore, if the second control valve is kept open due to a fault such as a short circuit in the electric system thereof, the interior of the evaporative emission control system can be excessively negatively pressurized.

Still further, according to the earlier application, when there occurs an abnormality in the electric system of the third control valve during the abnormality determination for the evaporative emission control system, the third control valve is kept closed even after normal purging is started, so that the interior of the evaporative emission control system becomes excessively negatively pressurized.

SUMMARY OF THE INVENTION

It is the object of the invention to provide an evaporative fuel-processing system for an internal combustion engine, which is capable of promptly detecting abnormalities in control valves used in an evaporative emission control system of the engine to thereby prevent an overnegative pressure state of the system, while avoiding an erroneous determination as to an abnormality in the evaporative emission control system.

To attain the object, the present invention provides an evaporative fuel-processing system for an internal combustion engine having an intake system, and a fuel tank, comprising:

a canister having an air inlet port provided therein;

an evaporative fuel-guiding passage extending from the fuel tank to the canister;

a first control valve arranged across the evaporative fuel-guiding passage;

a purging passage extending from the canister to the intake system of the engine;

a second control valve arranged across the purging passage;

a third control valve arranged at the air inlet port of the canister for establishing and interrupting communication between the interior of the canister and the atmosphere;

tank internal pressure detecting means for detecting pressure within the fuel tank;

control means for supplying operation command signals to the first to third control valves for closing or opening the same; and abnormality detecting means responsive to an output from the tank internal pressure detecting means and the operation command signals, for detecting an abnormality in operation of a predetermined one of the first to third control valves.

The abnormality detecting means determines that operation of the first control valve is abnormal when the pressure within the fuel tank detected by the tank internal pressure detecting means lowers by a predetermined amount or more while the control means is supplying the operation command signals for closing the first control valve, and closing the third control valve and opening the second control valve.

The abnormality detecting means determines that operation of the first control valve is abnormal when the pressure within the fuel tank detected by the tank internal pressure detecting means rises above a predetermined value while the control means is supplying the operation command signals for opening the first control valve, opening the second control valve, and opening the third control valve.

The abnormality detecting means determines that operation of the second control valve is abnormal when the pressure within the fuel tank detected by the tank internal pressure detecting means lowers by a predetermined amount or more while the control means is supplying the operation command signals for opening the first control valve, closing the second control valve, and closing the third control valve.

Preferably, the control means causes the first control valve to be closed when the control means determines that operation of the second control valve is abnormal.

The abnormality detecting means determines that operation of the third control valve is abnormal when said pressure within said fuel tank detected by the tank internal pressure detecting means lowers by a predetermined amount or more while the control means is supplying the operation command signals for opening said first control valve, opening the second control valve, and opening the third control valve.

Alternatively, the abnormality detecting means determines that operation of the third control valve is abnormal when the pressure within the fuel tank detected by the tank internal pressure detecting means lowers below a predetermined value while the control means is supplying the operation command signals for opening the first control valve, opening the second control valve, and opening the third control valve.

Preferably, the control means causes the second control valve to be closed when the control means determines that operation of the third control valve is abnormal.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
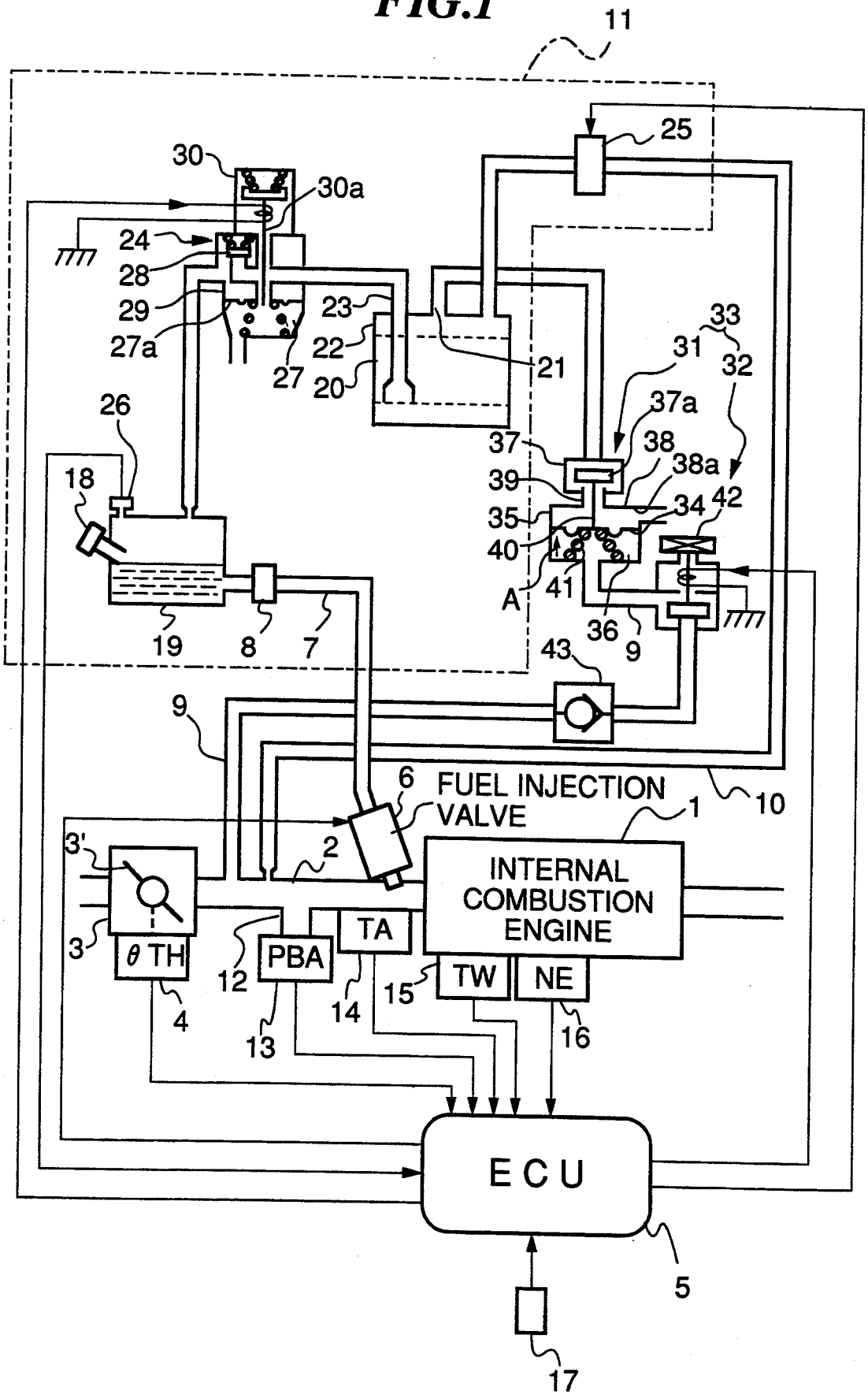
FIG. 1 is a block diagram showing the whole arrangement for an internal combustion engine and an evaporative fuel-processing system therefor, according to an embodiment of the invention.

Referring first to FIG. 1, there is illustrated the whole arrangement of an internal combustion engine and an evaporative fuel-processing system therefor according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7, and electrically connected to the ECU 5 to have their valve opening periods controlled by signals therefrom.

A negative pressure communication passage 9 and a purging passage 10 open into the intake pipe 2 at respective locations downstream of the throttle valve 3', both of which are connected to an evaporative emission control system 11, referred to hereinafter.

Further, an intake pipe absolute pressure (PBA) sensor 13 is provided in communication with the interior of the intake pipe 2 via a conduit 12 opening into the intake passage 2 at a location downstream of an end of the purging passage 10 opening into the intake pipe 2 for supplying an electric signal indicative of the sensed absolute pressure within the intake pipe 2 to the ECU 5.

An intake air temperature (TA) sensor 14 is inserted into the intake pipe 2 at a location downstream of the conduit 12 for supplying an electric signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

An ignition switch (IGSW) sensor 17 detects an ON (or closed) state of the ignition switch IGSW, to detect that the engine 1 is in operation, and supplies an electric signal indicative of the ON state of the ignition switch IGSW to the ECU 5.

The evaporative emission control system 11 is comprised of a fuel tank 19 having a filler cap 18 which is removed for refueling, a canister 22 containing activated carbon 20 as an adsorbent and having an air inlet port 21 provided in an upper wall thereof, an evaporative fuel-guiding passage 23 connecting between the canister 22 and the fuel tank 19, a first control valve 24 arranged across the evaporative fuel-guiding passage 23, and a purge control valve (second control valve) 25 arranged across the purging passage 10 extending from the canister 22.

The fuel tank 19 is connected to fuel injection valves 6 via the fuel pump 8 and the fuel supply pipe 7, and has a tank internal pressure (PT) sensor (hereinafter referred to as "the PT sensor") 26 mounted at an upper wall thereof. The PT sensor 26 is electrically connected to the ECU 5. The PT sensor 26 senses the pressure (tank internal pressure PT) within the fuel tank 19 and supplies an electric signal indicative of the sensed tank internal pressure PT to the ECU 5.

The first control valve 24 comprises a two-way valve 29 formed of a positive pressure valve 27 and a negative pressure valve 28, and a first electromagnetic valve 30 formed in one body with the two-way valve 29. More specifically, the first electromagnetic valve 30 has a rod 30*a*, a front end of which is fixed to a diaphragm 27*a* of the positive pressure valve 27. Further, the first electromagnetic valve 24 is electrically connected to the ECU 5 to have its operation controlled by a signal supplied from the ECU 5. When the first electromagnetic valve 30 is energized, the positive pressure valve 27 of the two-way valve 29 is forcedly opened to open the first control valve 24, whereas when the first electromagnetic valve 30 is deenergized, the valving (opening/closing) operation of the first control valve 24 is controlled by the two-way valve 29 alone.

The purge control valve 25 has a solenoid, not shown, electrically connected to the ECU 5. The purge control valve 25 is controlled by a signal supplied from the ECU 5 to linearly change the opening thereof. That is, the ECU 5 supplies a desired amount of control current to the purge control valve 25 to control the opening thereof.

A drain shut valve 31 is mounted across the negative pressure communication passage 9 connecting between the air inlet port 21 of the canister 22 and the intake pipe 2, and a second electromagnetic valve 32 is mounted across the negative pressure communication passage 9 at a location downstream of the drain shut valve 31, the drain shut valve 31 and the second electromagnetic valve 32 constituting a third control valve 33.

The drain shut valve 31 has an air chamber 35 and a negative pressure chamber 36 defined by a diaphragm 34. Further, the air chamber 35 is formed of a first chamber 37 accommodating a valve element 37*a*, a second chamber 38 formed with an air introducing port 38*a*, and a narrowed communicating passage 39 connecting the second chamber 38 with the first chamber 37. The valve element 37*a* is connected via a rod 40 to the diaphragm 34. The negative pressure chamber 36 communicates with the second electromagnetic valve 32 via the communication passage 9, and has a spring 41 arranged therein for resiliently urging the diaphragm 34 and hence the valve element 37*a* in the direction indicated by an arrow A.

The second electromagnetic valve 32 is constructed such that when a solenoid thereof is deenergized, a valve element thereof is in a seated position to allow air to be introduced into the negative pressure chamber 36 via an air inlet port 42, and when the solenoid is energized, the valve element is in a lifted position in which the negative pressure chamber 36 communicates with the intake pipe 2 via the communication passage 9. In addition, reference numeral 43 indicates a check valve.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, the first and second electromagnetic valves 30, 32, and the purge control valve 25.

Figure 2:
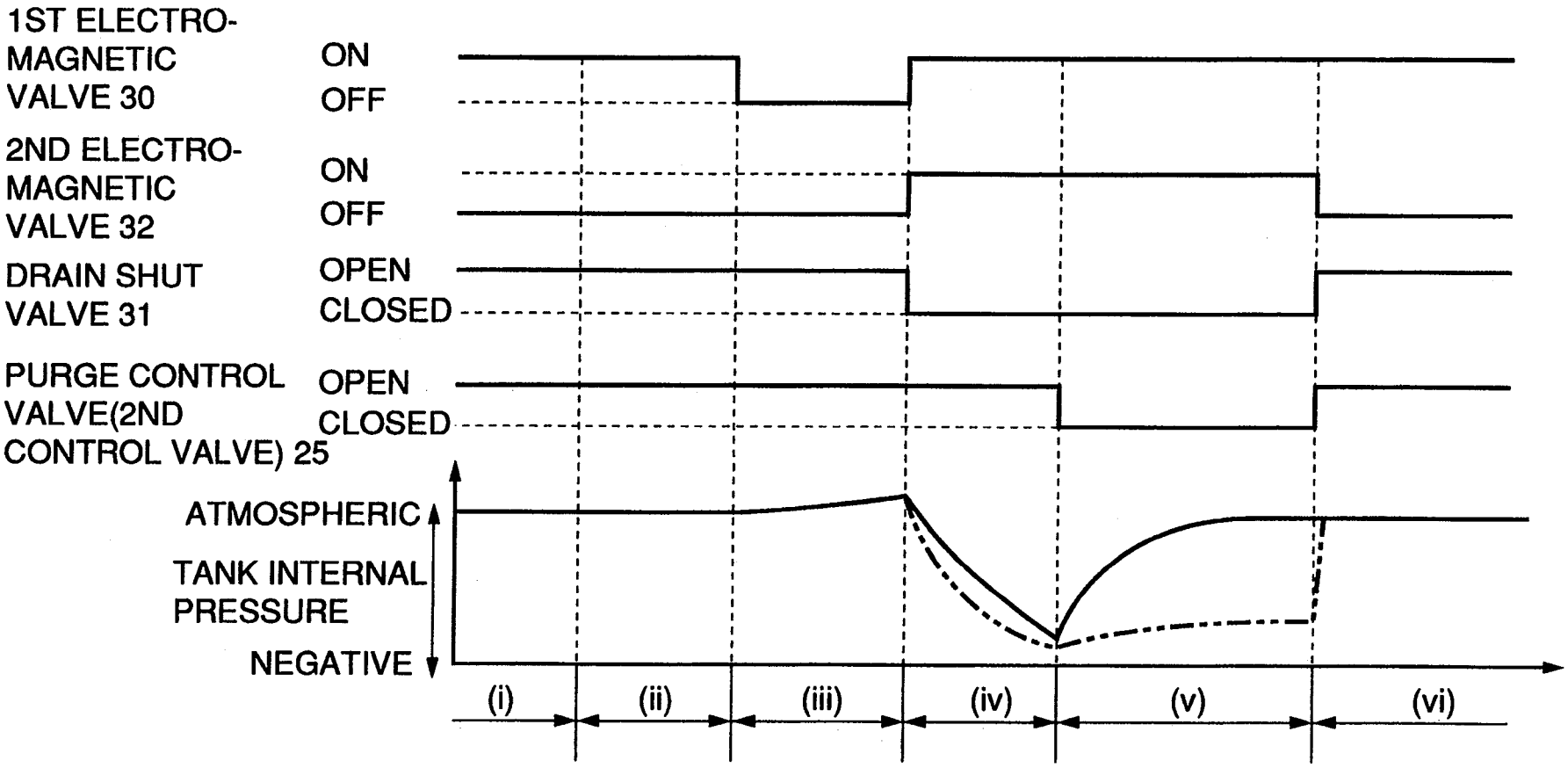
FIG. 2 is a timing chart showing operating patterns of first and second electromagnetic valves and a drain shut valve, all appearing in FIG. 1.

FIG. 2 shows patterns of operations of the first and second electromagnetic valves 30, 32 and the drain shut valve 31 and the purge control valve 25 performed during an diagnosis of abnormality of the evaporative emission control system 11, and changes in the tank internal pressure PT occurring during the diagnosis. The operations of these valves are commanded by control signals from the ECU 5.

First, during normal operation (normal purging) of the engine, as indicated by (i) in FIG. 2, the first electromagnetic valve 30 is energized and at the same time the second magnetic valve 32 is deenergized. When the ignition switch is closed and the engine is detected to be operating, by the IGSW sensor 17, the purge control valve 25 is energized to be opened. Then, evaporative fuel generated within the fuel tank 19 is allowed to flow through the evaporative fuel-guiding passage 23 into the canister 22 to be temporarily adsorbed by the adsorbent 20. Since the second electromagnetic valve 32 is deenergized as mentioned above, the drain shut valve 31 is open to allow fresh air to be introduced into the canister 22 through the air inlet port 38a so that evaporative fuel flowing into and stored in the canister 22 is purged together with fresh air through the second control valve 25 into the purging passage 10. On this occasion, if the fuel tank 19 is cooled due to ambient air, etc., negative pressure is developed within the fuel tank 19, which causes the negative pressure valve 28 of the two-way valve 24 to be opened so that part of the evaporative fuel in the canister 22 is returned through the two-way valve 24 into the fuel tank 19.

When predetermined abnormality determining conditions are satisfied, the first and second electromagnetic valves 30, 32, and the purge control valve 25 are operated in the following manner to carry out an abnormality diagnosis of the evaporative emission control system 11.

First, the tank internal pressure PT is relieved to the atmosphere, over a time period indicated by (ii) in FIG. 2. More specifically, the first electromagnetic valve 30 is held in the energized state to maintain communication between the fuel tank 19 and the canister 22, and at the same time the second electromagnetic valve 32 is held in the deenergized state to keep the drain shut valve 31 open. Further, the purge control valve 25 is held in the energized state or opened, to relieve the tank internal pressure PT to the atmosphere.

Then, an amount of change in the tank internal pressure PT is measured over a time period indicated by (iii) in FIG. 2.

More specifically, the second electromagnetic valve 32 is held in the deenergized state to keep the drain shut valve 31 open, and at the same time the purge control valve 25 is kept open. However, the first electromagnetic valve 30 is turned off into the deenergized state, to thereby measure an amount of change in the tank internal pressure PT occurring after the fuel tank 19 has ceased to be open to the atmosphere for the purpose of checking an amount of evaporative fuel generated in the fuel tank 19.

Then, the evaporative emission control system 11 is negatively pressurized over a time period indicated by (iv) in FIG. 2. More specifically, the first electromagnetic valve 30 and the purge control valve 25 are held in the energized state, while the second electromagnetic valve 32 is turned on to close the drain shut valve 31, whereby the evaporative emission control system 11 is negatively pressurized by a gas drawing force developed by negative pressure in the purging passage 10 held in communication with the intake pipe 2.

Then, a leak down check is carried out over a time period indicated by (v) in FIG. 2.

More specifically, after the evaporative emission control system 11 is negatively pressurized to a predetermined degree, i.e. after the predetermined negatively-pressurized condition of the system is established, the purge control valve 25 is closed, and then a change in the tank internal pressure PT occurring thereafter is checked by the PT sensor 26. If the system 11 does not suffer from a significant leak of evaporative fuel therefrom, and hence the result of the leak down check shows that there is no substantial change in the tank internal pressure PT as indicated by the two-dot-chain line in the figure, it is determined that the evaporative emission control system 11 is normal, whereas if the system 11 suffers from a significant leak of evaporative fuel therefrom, and hence the result of the leak down check shows that there is a significant change in the tank internal pressure PT toward the atmospheric pressure, it is determined whether or not the system 11 is abnormal, by taking into account the measured amount of change in the tank internal pressure obtained at (iii) in FIG. 2.

After determining whether or not the system 11 is abnormal, the system 11 returns to the normal purging mode, as indicated by (vi) in FIG. 2.

More specifically, while the first electromagnetic valve 30 is held in the energized state, the second electromagnetic valve 32 is deenergized and the purge control valve 25 is opened, to thereby perform normal purging of evaporative fuel. In this state, the tank internal pressure PT is relieved to the atmosphere, and hence is substantially equal to the atmospheric pressure.

Figure 3:
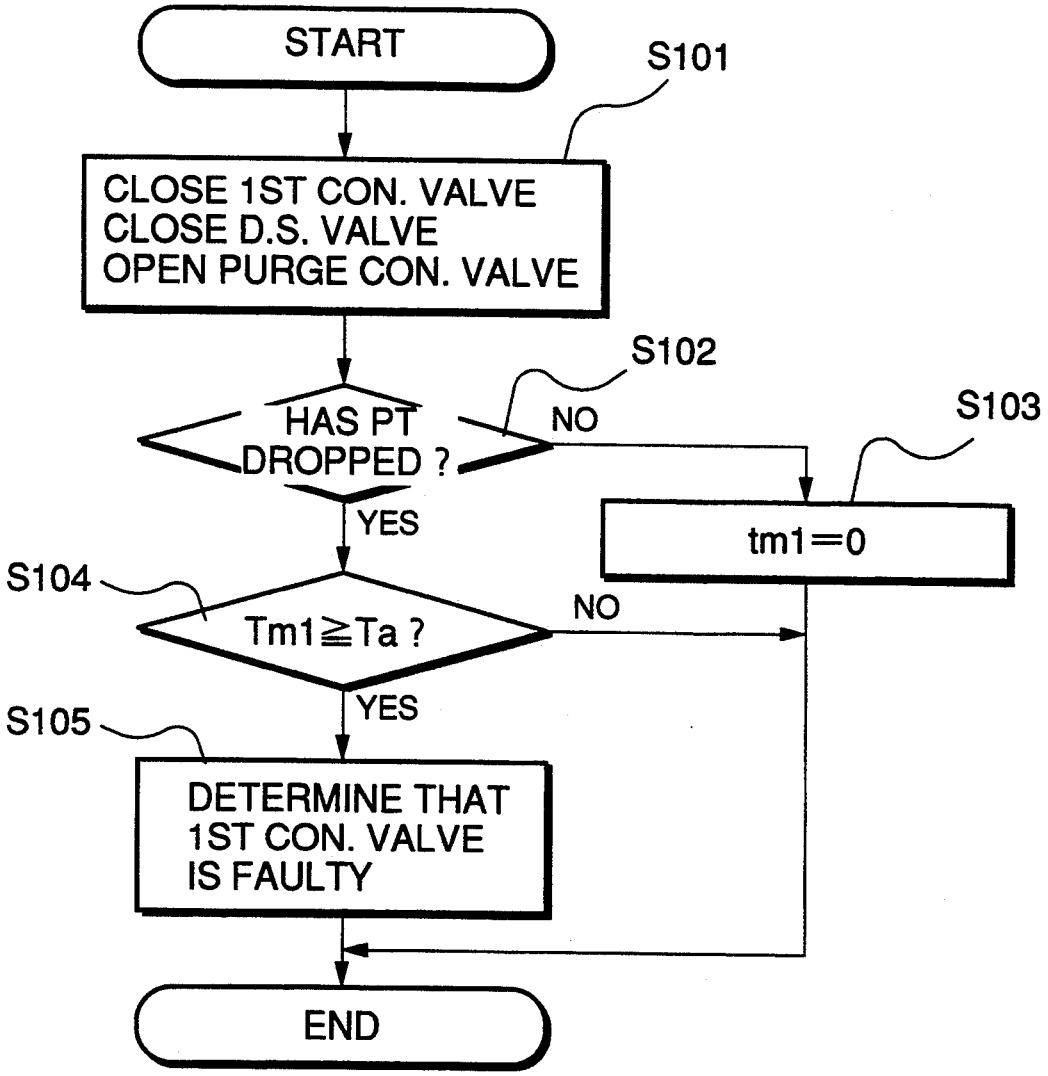
FIG. 3 is a flowchart showing a program for determining an abnormality in a first control valve of an evaporative emission control system of the engine, according to a first embodiment of the invention.

FIG. 3 shows a program for determining an abnormality in the first control valve 24 of the evaporative emission control system 11, according to a first embodiment of the invention, which is executed by the ECU 5 as a background processing.

First, at a step S101, the first control valve 24 is closed by deenergizing the first electromagnetic valve 30, the drain shut valve 31 is closed by energizing the second control valve 32, and the purge control valve 25 is energized to open. Then, it is determined at a step S102 whether or not the tank internal pressure PT detected by the PT sensor 26 has dropped by a predetermined value (e.g. 10 mmHg) or more. If the answer to this question is negative (NO), a timer tm1 is reset to 0 at a step S103, followed by terminating the program, whereas if the answer is affirmative (YES), it is determined at a step S104 whether or not the timer tm1 has counted up a predetermined time period Ta (e.g. 5 sec). If the answer to this question is negative (NO), the program is immediately terminated, whereas if the answer is affirmative (YES), it is determined at a step S105 that the first control valve 24 is faulty, i.e. it is held open due to a fault, followed by terminating the program.

That is, the answer to the question of the step S104 becomes affirmative (YES) when the tank internal pressure PT has changed toward a lower pressure side in spite of the fact that the deenergization command signal has been supplied to the first electromagnetic valve 30. In other words, when the first electromagnetic valve 30 is deenergized, the first control valve 24 is controlled by the two-way valve 29 such that usually the first control valve 24 is not opened. Therefore, on such an occasion, the tank internal pressure PT will not change toward the lower pressure side. Therefore, if the tank internal pressure PT drops on such an occasion, it is presumed that the first control valve 24 is kept open due to a fault such as a short circuit in the electric system of the first electromagnetic valve 30 which keeps the valve 30 open, and it is thus determined that the first control valve 24 is abnormal.

Figure 4:
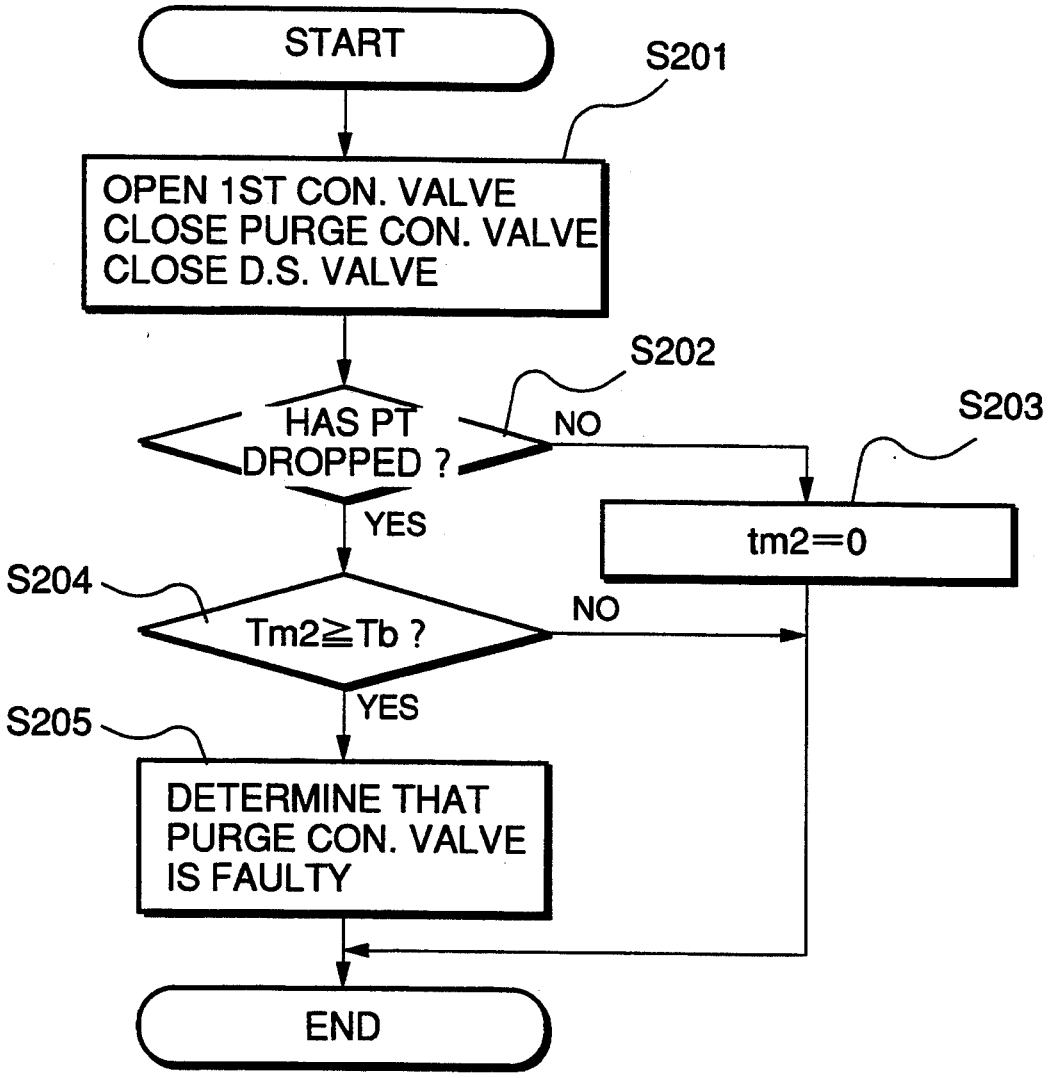
FIG. 4 is a flowchart showing a program for determining an abnormality in a second control valve of the evaporative emission control system, according to a second embodiment of the invention.

FIG. 4 shows a program for determining an abnormality in the purge control valve or second control valve 25 of the evaporative emission control system 11, according to a second embodiment of the invention, which is executed by the ECU 5 as a background processing.

First, at a step S201, the first control valve 24 is opened by energizing the first electromagnetic valve 30, the drain shut valve 31 is closed by energizing the second electromagnetic valve 32, and the purge control valve 25 is deenergized to close. Then, it is determined at a step S202 whether or not the tank internal pressure PT detected by the PT sensor 26 has dropped by a predetermined value (e.g. 10 mmHg) or more. If the answer to this question is negative (NO), a timer tm2 is reset to 0 at a step S203, followed by terminating the porgram, whereas if the answer is affirmative (YES), it is determined at a step S204 whether or not the timer tm2 has counted up a predetermined time period Tb (e.g. 5 sec). If the answer to this question is negative (NO), the program is immediately terminated, whereas if the answer is affirmative (YES), it is determined at a step S205 that the second control valve 25 is faulty, i.e. it is held open due to a fault, followed by terminating the program.

That is, if the answer to the question of the step S204 is affirmative (YES), it can be presumed that although the closure command signal has been supplied to the solenoid of the purge control valve 25 at the step S201, the interior of the evaporative emission control system 11 has been negatively pressurized due to an incomplete disconnection between the canister 22 and the intake pipe 2 of the engine 1, and thus it is determined at the step S205 that the purge control valve 25 is kept open due to a fault such as a short circuit in the electric system of the valve 25.

Figure 5:
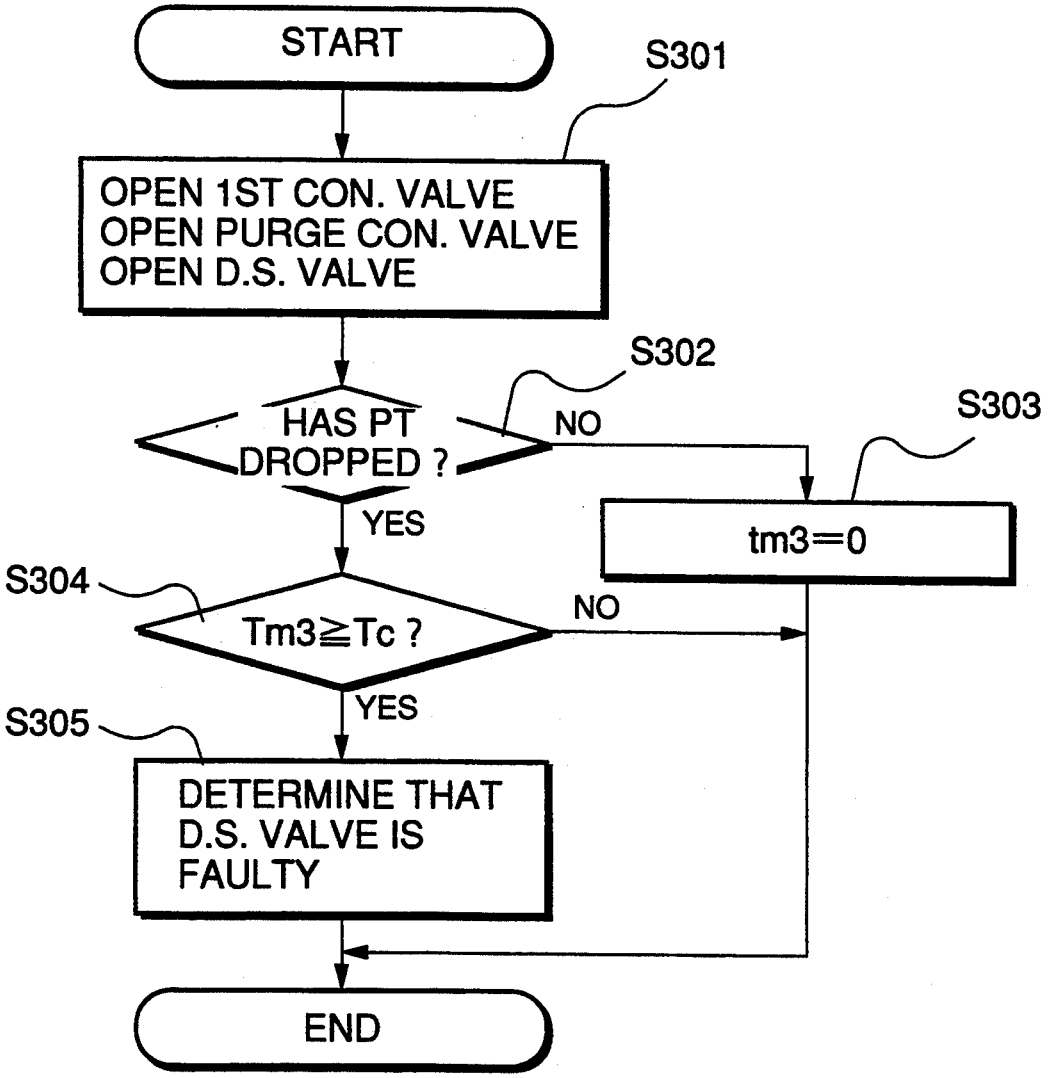
FIG. 5 is a flowchart showing a program for determining an abnormality in a third control valve of the evaporative emission control system, according to a third embodiment of the invention.

FIG. 5 shows a program for determining an abnormality in the third control valve 33 of the evaporative emission control system 11, according to a third embodiment of the invention, which is executed by the ECU 5 as a background processing.

First, at a step S301, the first control valve 24 is opened by energizing the first electromagnetic valve 30, the drain shut valve 31 is opened by deenergizing the second electromagnetic valve 32, and the purge control valve 25 is energized to open. Then, it is determined at a step S302 whether or not the tank internal pressure PT detected by the PT sensor 26 has dropped by a predetermined value (e.g. 10 mmHg) or more. If the answer to this question is negative (NO), a timer tm3 is reset to 0 at a step S303, followed by terminating the porgram, whereas if the answer is affirmative (YES), it is determined at a step S304 whether or not the timer tm3 has counted up a predetermined time period Tc (e.g. 5 sec). If the answer to this question is negative (NO), the program is immediately terminated, whereas if the answer is affirmative (YES), it is determined at a step S305 that the third control valve 33 is faulty, i.e. it is held closed due to a fault, followed by terminating the program.

That is, when the tank internal pressure PT has dropped by the predetermined value or more in spite of the fact that the drain shut valve 31 has been commanded to be opened, it can be presumed that there is a short circuit in the electric system of the second electromagnetic valve 32 which causes the drain shut valve 31 to be kept closed, and hence it is judged that the third control valve 33 is abnormal.

Figure 6:
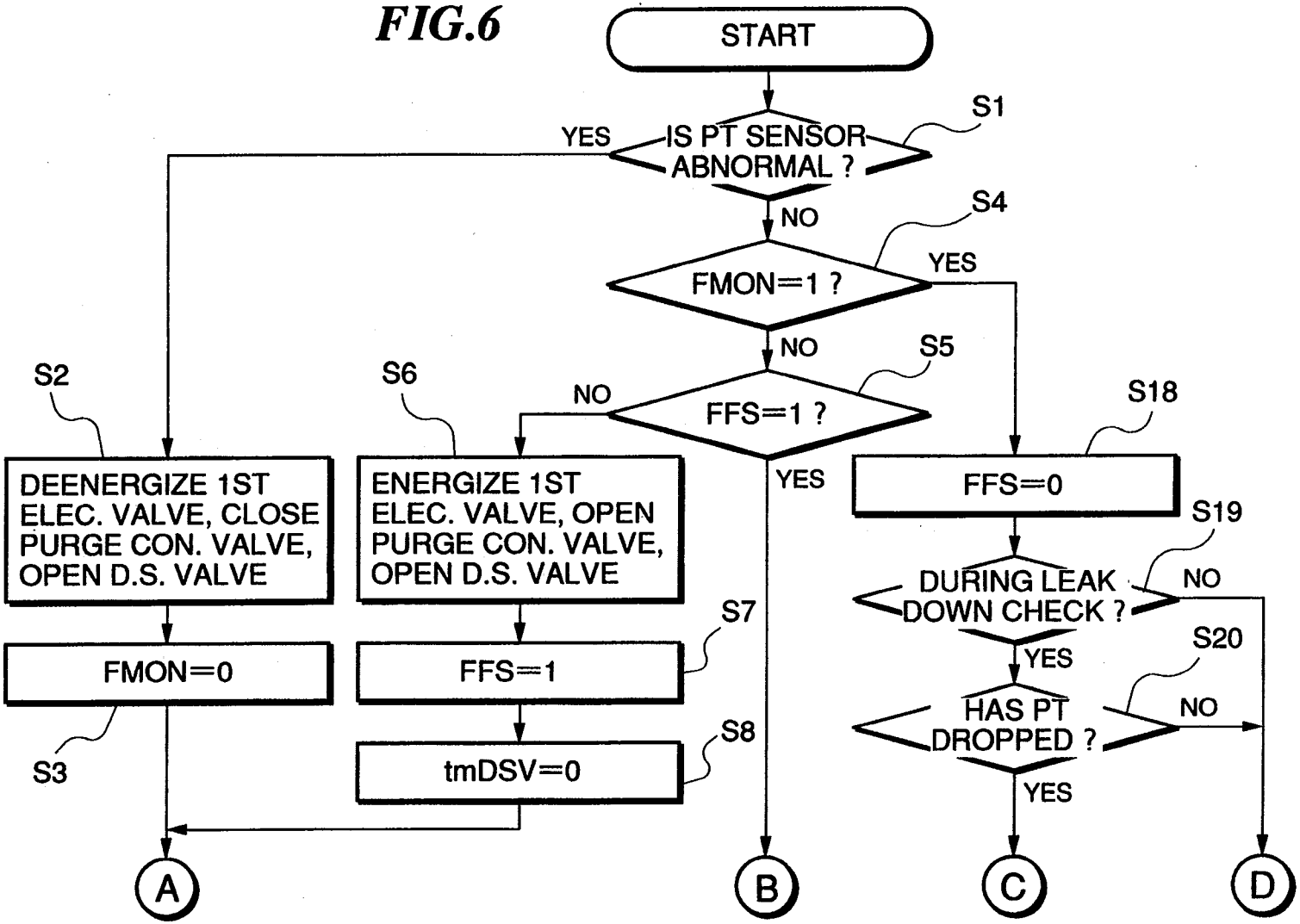
FIG. 6 is a flowchart showing part of a program for determining abnormalities in all the control valves of the evaporative emission control system of the engine, according to a fourth embodiment of the invention.
Figure 7:
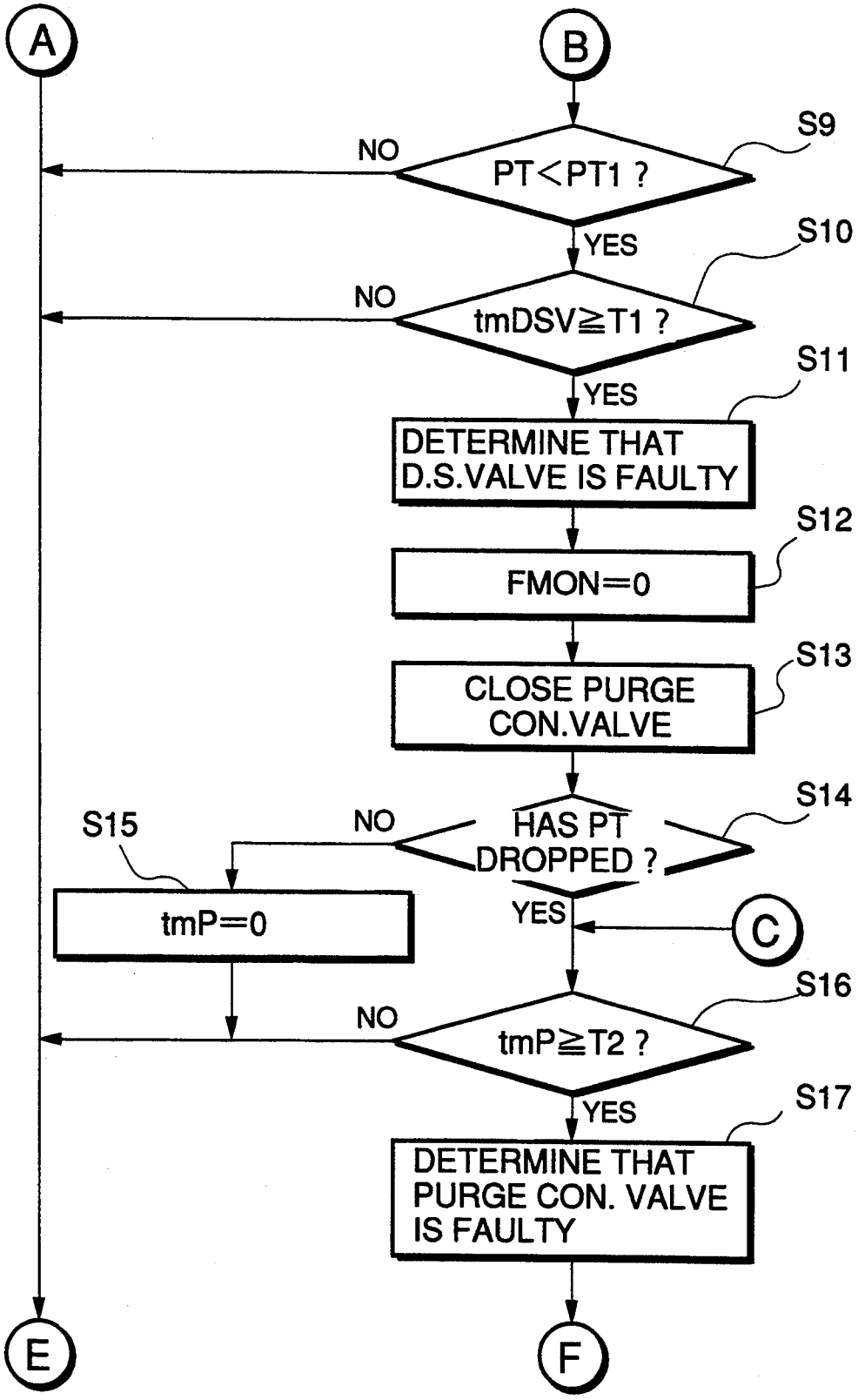
FIG. 7 is a flowchart showing a further part of the program of FIG. 6.
Figure 8:
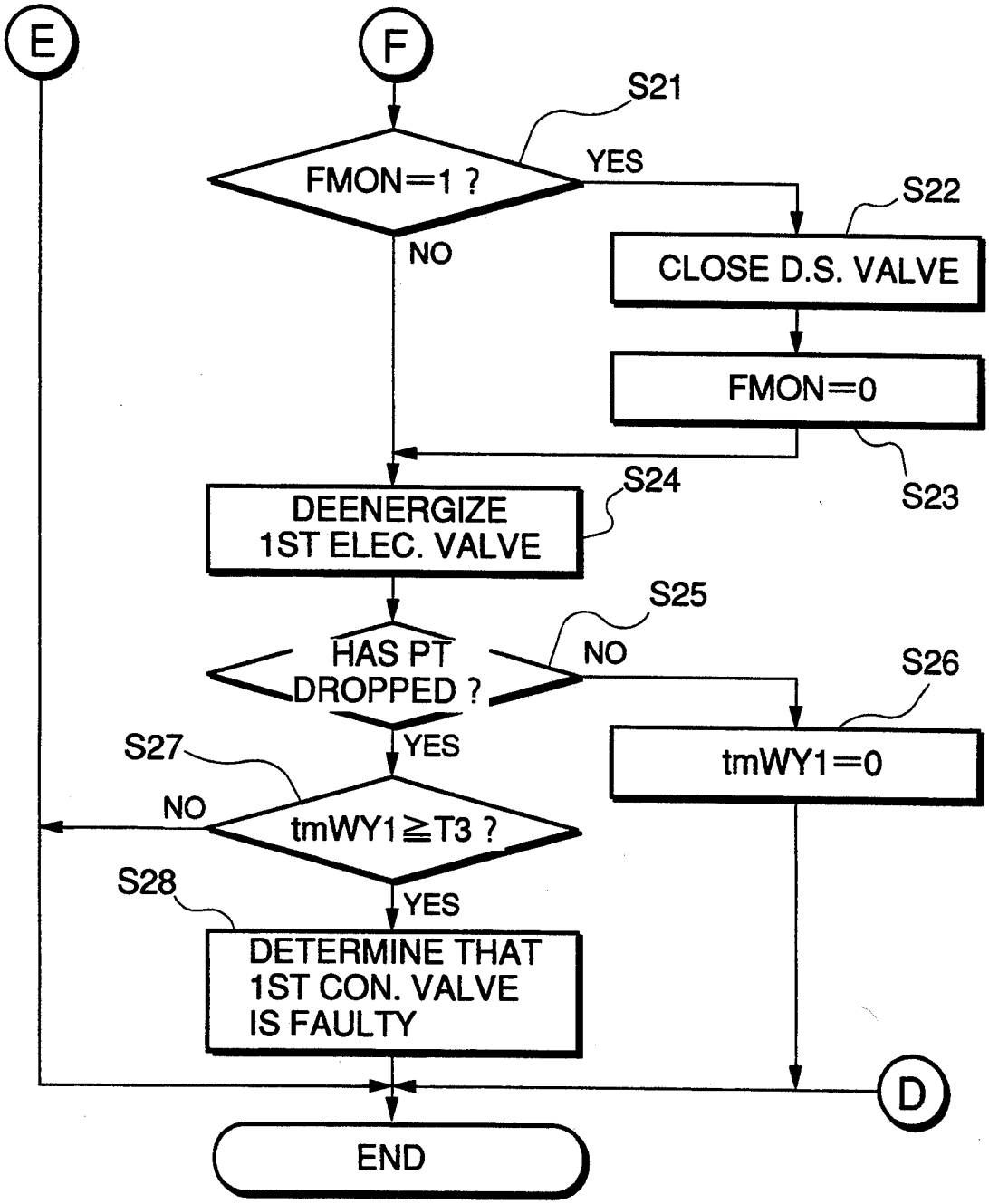
FIG. 8 is a flowchart showing another part of the program of FIG. 6.

FIGS. 6–8 show a program for determining abnormaities in all of the first to third control valves of the evaporative emission control system 11, according to a fourth embodiment of the invention, which is executed by the ECU 5 (CPU) as a background processing.

First, at a step S1 in FIG. 6, it is determined whether or not the PT sensor 26 is abnormal. This determination is made based, e.g. upon a difference between an immediately preceding value of an amount of change in the output from the PT sensor 16 and a present value of the same, by a PT sensor abnormality determining subroutine, not shown. If the answer to the question of the step S1 is affirmative (YES), that is, if the PT sensor 26 is abnormal, the first electromagnetic valve 30 is deenergized and the purge control valve 25 is closed, at a step S2. Further, at the same time, the second electromagnetic valve 32 is deenergized to open the drain shut valve 31, at the step S2. Then, a flag FMON is set to a value of 0 to inhibit the diagnosis of abnormality of the evaporative emission control system 11, followed by terminating the program. That is, since the abnormality determination of the evaporative emission control system 11 is carried out based upon the output value of the PT sensor 26, the same abnormality determination is inhibited when the PT sensor 26 is abnormal.

On the other hand, if the answer to the question of the step S1 is negative (NO), it is determined at a step S4 whether or not the flag FMON is equal to a value of 1 to determine whether or not the abnormality diagnosis of the evaporative emission control system is being carried out. The abnormality diagnosis of the system 11 is executed when predetermined abnormality determining conditions are satisfied depending upon values of various engine operating parameters including intake pipe absolute pressure PBA, intake air temperature TA, engine coolant temperature TW, and engine rotational speed NE. In other words, an abnormality determination permission routine is executed to determine fulfillment of the predetermined abnormality determining conditions. When the predetermined abnormality determining conditions are fulfilled, the flag FMON is set to 1 to permit execution of the abnormality diagnosis of the evaporative emission control system 11. If the answer to the question of the step S4 is negative (NO), that is, when the abnormality diagnosis is not being carried out, the program proceeds to a step S5, wherein it is determined whether or not a flag FFS has been set to a value of 1 to determine whether or not the present loop is in a mode for carrying out an abnormality determination of the control valves. If the answer to this question is negative (NO), the first electromagnetic valve 30 is energized and at the same time the purge control valve 25 and the drain shut valve 31 are opened to set the present mode to a normal purging mode, at a step S6. Further, the flag FFS is set to 1 to set the valve abnormality determining mode at a step S7, and a timer tmDSV is reset to 0 at a step S8, followed by terminating the program.

Since the flag FFS has thus been set to 1 at the step S7, in the next loop the answer to the question of the step S5 becomes affirmative (YES), and then it is determined at a step S9 in FIG. 7 whether or not the tank internal pressure PT detected by the PT sensor 26 is lower than a predetermined value PT1. The predetermined value PT1 is set to a value (e.g.—40 mmHg) which is on the negative side with respect to the tank internal pressure value corresponding to the predetermined negatively pressurized state into which the interior of the evaporative emission control system 11 is to be brought for the abnormality diagnosis. If the answer to this question is negative (NO), the program is immediately terminated, whereas if the answer is affirmative (YES), it is determined at a step S10 whether or not the first timer tmDSV has counted up a first predetermined time period T1 (e.g. 5 sec). If the answer to this question is negative (NO), the program is immediately terminated, whereas if the answer is affirmative (YES), it is determined at a step S11 that the drain shut valve 31 is kept closed due to a fault. That is, by a reason similar to that mentioned with respect to the steps S304 and S305 in FIG. 5, when the tank internal pressure PT has dropped below the predetermined value PT1 in spite of the fact that the drain shut valve 31 has been commanded to be opened, it can be presumed that there is a short circuit in the electric system of the second electromagnetic valve 32 which causes the drain shut valve 31 to be kept closed, and hence it is judged that the third control valve 33 is abnormal.

When it is thus determined that the drain shut valve 31 is kept closed to due to a fault, the program proceeds to a step S12, wherein the flag FMON is set to 0 to inhibit execution of the abnormality diagnosis of the evaporative emission control system 11 from being executed in the next loop, and a closure command signal is supplied to the solenoid of the purge control valve 25 to close the same. That is, when the drain shut valve 31 is kept closed due to a fault, the purge control valve 25 is closed to thereby avoid the evaporative emission control system 11 from being excessively negatively pressurized and hence protect component parts of the system 11 such as the canister 22 and the fuel tank 19 from being placed under overnegative pressure.

Then, at a step S14, it is determined whether or not the tank internal pressure PT has further dropped by a predetermined value (e.g. 10 mmHg) or more. If the answer to this question is negative (NO), a second timer tmP is reset to 0 at a step S15, followed by terminating the program. When the answer to the question of the step S14 becomes affirmative (YES) in a subsequent loop, the program proceeds to a step S16, wherein it is determined whether or not the second timer tmP has counted up a second predetermined time period T2 (e.g. 5 sec). If the answer to this question is negative (NO), the program is immediately terminated, whereas if the answer is affirmative (YES), as already mentioned with respect to the steps S204, S205 in FIG. 4, it is presumed that although the closure command signal has been supplied to the solenoid of the purge control valve 25 at the step S13, the interior of the evaporative emission control system 11 has been negatively pressurized due to an incomplete disconnection between the canister 22 and the intake pipe 2 of the engine 1, and then it is determined at a step S17 that the purge control valve 25 is kept open due to a fault such as a short circuit in the electric system of the valve 25.

On the other hand, if the answer to the question of the step S4 in FIG. 6 is affirmative (YES), the flag FFS is set to 0 to inhibit the abnormality determination of the control valves at a step S18, followed by determining at a step S19 whether or not the leak down check is being carried out ((v) in FIG. 2). If the answer is negative (NO), the program is immediately terminated, whereas if the answer is affirmative (YES), the program proceeds to a step S20 to determine whether or not the tank internal pressure PT has dropped by a predetermined value (e.g. 10 mmHg) or more. If the answer to this question is negative (NO), the program is immediately terminated, whereas if the answer is affirmative (YES), the program proceeds to the step S16 in FIG. 7 to determine whether or not the second timer tmP has counted up the second predetermined time period T2 (e.g. 5 sec). If the answer to this question is affirmative (YES), it is determined at the step S17 that the purge control valve 25 is kept open due to a fault, similarly to the above.

When the purge control valve 25 has thus been determined to be faulty, the program proceeds to a step S21 in FIG. 8, wherein it is determined whether or not the flag FMON is equal to 1. If the answer to this question is negative (NO), that is, if the abnormality of the purge control valve 25 has been detected through the loop of steps S4, S5, S9, . . . S14, and S16 executed in the order mentioned, the program proceeds to a step S24, wherein the first electromagnetic valve 30 is deenergized to let the first control valve 24 be controlled by the two-way valve 29, to thereby avoid the fuel tank 19 from being brought into an overnegative pressure state.

On the other hand, if the answer to the question of the step S21 is affirmative (YES), that is, if the abnormality of the purge control valve 25 has been detected through the loop of steps S4, S18, S19, S20, and S16 executed in the order mentioned, the supply of the opening or energization command signal to the purge control valve 25 is interrupted and at the same time the second electromagnetic valve 32 is energized to close the drain shut valve 31, at a step S22. Further, the flag FMON is set to 0 to inhibit the abnormality diagnosis of the evaporative emission control system 11 at a step S23, followed by sending a deenergization command signal to the first electromagnetic valve 30 at a step S24 to prevent the fuel tank 19 from being brought into an overnegative pressure state. Then, the program proceeds to a step S25 to determine whether or not the tank internal pressure PT has further dropped by a predetermined value (e.g. 10 mmHg) or more. If the answer to this question is negative (NO), a third timer tmWY1 is reset to 0 at a step S26, followed by terminating the program, whereas if the answer is affirmative (YES), it is determined at a step S27 whether or not the third timer tmWY1 has counted up a third predetermined time period T3 (e.g. 5 sec). If the answer to this question is negative (NO), the program is immediately terminated, whereas if the answer is affirmative (YES), it is determined at a step S28 that the first control valve 24 is kept open due to a fault, followed by terminating the program.

That is, the answer to the question of the step S27 becomes affirmative (YES) when the tank internal pressure PT has changed toward a lower pressure side in spite of the fact that the deenergization command signal has been supplied to the first electromagnetic valve 30. In other words, when the first electromagnetic valve 30 is deenergized, the first control valve 24 is controlled by the two-way valve 29 such that usually the first control valve 24 is not opened. Therefore, on such an occasion, the tank internal pressure PT will not change toward the lower pressure side. Therefore, as already mentioned with respect to the steps S104, S105 in FIG. 3, if the tank internal pressure PT drops on such an occasion, it is presumed that the first control valve 24 is kept open due to a fault such as a short circuit in the electric system of the first electromagnetic valve 30 which keeps the valve 30 open, and it is thus determined that the first control valve 24 is abnormal.

By executing the valve abnormality determining routine in the above described manner, detection of abnormalities in the third control valve 33 (drain shut valve 31 and second electromagnetic valve 32), the purge control valve 25, and the first control valve 24 (first electromagnetic valve 30) can be carried out in a sequential manner, and at the same time the evaporative emission control system 11 can be prevented from being brought into an overnegative pressure state.

Although in the above described valve abnormality determining routine abnormalities in all the control valves are detected by the use of a single program, it is also preferable to send the deenergization command signal to the first electromagnetic valve 30 to detect abnormality of the first control valve 24, after the drain shut valve 31 has been closed and the purge control valve 24 has been opened. In this alternative case, if the first control valve 24 is determined to be abnormal, the abnormality diagnosis may be inhibited by opening the drain shut valve 31, to prevent the canister 22 and the fuel tank 19 from being brought into an overnegative pressure state.

Figure 9:
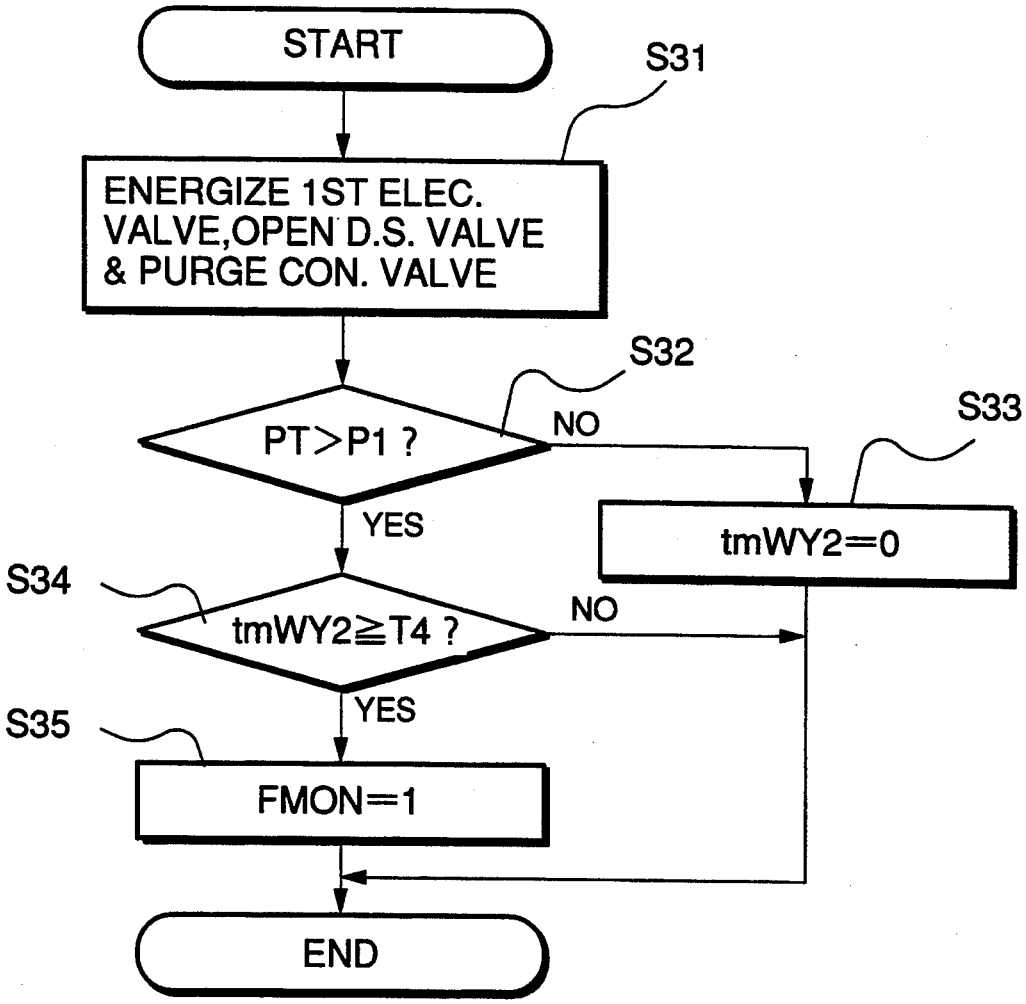
FIG. 9 is a flowchart showing an abnormality in the first control valve of the evaporative emission control system, according to a fifth embodiment of the invention.

FIG. 9 shows a program for determining an abnormality of the first control valve 24, of the kind that the valve 24 is kept closed due to a fault, which program is also executed as a background processing.

First, at a step S31, the drain shut valve 31 and the purge control valve 25 are opened, and at the same time an energization command signal is supplied to the first electromagnetic valve 30. Then, it is determined at a step S32 whether or not the tank internal pressure PT is higher than a predetermined value P1. The predetermined value P1 is set to a value lower than the set valve opening pressure of the positive valve 27 of the two-way valve 29, e.g. +5 mmHg. If the answer to this question is negative (NO), a fourth timer tmWY2 is reset to 0, at a step S33, followed by terminating the program. When in a subsequent loop the answer to the question of the step S32 becomes affirmative (YES), it is determined at a step S34 whether or not the fourth timer tmWY2 has counted up a fourth predetermined time period T4 (e.g. 5 sec). If the answer to this question is affirmative (YES), it is determined that the first control valve 24 is kept closed due to a fault such as a disconnection in the electric system of the first electromagnetic valve 30 which keeps the valve 24 closed, and the flag FMON is set to 0 to inhibit the abnormality diagnosis of the evaporative emission control system 11, at a step S35, followed by terminating the program.

As described above, according to the embodiment, it is possible in combination with the program of FIGS. 6–8 to detect the two kinds of abnormalities in the first control valve 24, i.e. the valve 24 is kept open and it is kept closed, in a prompt manner, to thereby prevent the evaporative emission control system 11 from being damaged by overnegative pressure, as well as prevent a misjudgment on the presence of abnormalities in the control valves.

What is claimed is:

1. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage, said first control valve being controllable to be opened or closed for detection of an abnormality of said evaporative fuel-processing system;

a purging passage extending from said canister to said intake system of said engine;

a second control valve arranged across said purging passage;

a third control valve arranged at said air inlet port of said canister for establishing and interrupting communication between the interior of said canister and the atmosphere;

tank internal pressure detecting means for detecting pressure within said fuel tank;

control means for supplying operation command signals to said first to third control valves at the same time for closing or opening the same; and abnormality detecting means responsive to an output from said tank internal pressure detecting means and said operation command signals, for detecting an abnormality in operation of a predetermined one of said first to third control valves.

2. An evaporative fuel-processing system as claimed in claim 1, wherein said abnormality detecting means determines that operation of said third control valve is abnormal when said pressure within said fuel tank detected by said tank internal pressure detecting means lowers by a predetermined amount or more while said control means is supplying said operation command signals for opening said first control valve, opening said second control valve, and opening said third control valve.

3. An evaporative fuel-processing system as claimed in claim 1, wherein said abnormality detecting means determines that operation of said third control valve is abnormal when said pressure within said fuel tank detected by said tank internal pressure detecting means lowers below a predetermined value while said control means is supplying said operation command signals for opening said first control valve, opening said second control valve, and opening said third control valve.

4. An evaporative fuel-processing system as claimed in claim 3, wherein said control means causes said second control valve to be closed when said control means determines that operation of said third control valve is abnormal.

5. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage;

a purging passage extending from said canister to said intake system of said engine;

a second control valve arranged across said purging passage;

a third control valve arranged at said air inlet port of said canister for establishing and interrupting communication between the interior of said canister and the atmosphere;

tank internal pressure detecting means for detecting pressure within said fuel tank;

control means for supplying operation command signals to said first to third control valves for closing or opening the same; and abnormality detecting means responsive to an output from said tank internal pressure detecting means and said operation command signals, for detecting an abnormality in operation of a predetermined one of said first to third control valves, wherein said abnormality detecting means determines that operation of said first control valve is abnormal when said pressure within said fuel tank detected by said tank internal pressure detecting means lowers by a predetermined amount or more while said controlled means is supplying said operation command signals for closing said first control valve, closing said third control valve and opening said second control valve.

6. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage;

a purging passage extending from said canister to said intake system of said engine;

a second control valve arranged across said purging passage;

a third control valve arranged at said air inlet port of said canister for establishing and interrupting communication between the interior of said canister and the atmosphere;

tank internal pressure detecting means for detecting pressure within said fuel tank;

control means for supplying operation command signals to said first to third control valves for closing or opening the same; and abnormality detecting means responsive to an output from said tank internal pressure detecting means and said operation command signals, for detecting an abnormality in operation of a predetermined one of said first to third control valves, wherein said abnormality detecting means determines that operation of said first control valve is abnormal when said pressure within said fuel tank detected by said tank internal pressure detecting means rises above a predetermined value while said control means is supplying said operation command signals for opening said first control valve, opening said second control valve, and opening said third control valve.

7. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage;

a purging passage extending from said canister to said intake system of said engine;

a second control valve arranged across said purging passage;

a third control valve arranged at said air inlet port of said canister for establishing and interrupting communication between the interior of said canister and the atmosphere;

tank internal pressure detecting means for detecting pressure within said fuel tank;

control means for supplying operation command signals to said first to third control valves for closing or opening the same; and abnormality detecting means responsive to an output from said tank internal pressure detecting means and said operation command signals, for detecting an abnormality in operation of a predetermined one of said first to third control valves, wherein said abnormality detecting means determines that operation of said second control valve is abnormal when said pressure within said fuel tank detected by said tank internal pressure detecting means lowers by a predetermined amount or more while said control means is supplying said operation command signals for opening said first control valve, closing said second control valve, and closing said third control valve.

8. An evaporative fuel-processing system as claimed in claim 7, wherein said control means causes said first control valve to be closed when said control means determines that operation of said second control valve is abnormal.

9. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage, said first control valve being controllable to be opened or closed for detection of an abnormality of said evaporative fuel-processing system;

a purging passage extending from said canister to said intake system of said engine;

a second control valve arranged across said purging passage;

a third control valve arranged at said air inlet port of said canister for establishing and interrupting communication between the interior of said canister and the atmosphere;

system internal pressure detecting means arranged at a location in a part of said evaporative fuel-processing system upstream of said first control valve for detecting pressure within said part of said evaporative fuel-processing system;

control means for supplying operation command signals to said first to third control valves at the same time for closing or opening the same; and abnormality detecting means responsive to an output from said system internal pressure detecting means and said operation command signals, for detecting an abnormality in operation of a predetermined one of said first to third control valves.

10. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage;

a purging passage extending from said canister to said intake system of said engine;

a second control valve arranged across said purging passage;

a third control valve arranged at said air inlet port of said canister for establishing and interrupting communication between the interior of said canister and the atmosphere;

system internal pressure detecting means arranged at a location in a part of said evaporative fuel-processing system upstream of said first control valve for detecting pressure within said part of said evaporative fuel-processing system;

control means for supplying operation command signals to said first to third control valves for closing or opening the same; and abnormality detecting means responsive to an output from said system internal pressure detecting means and said operation command signals, for detecting an abnormality in operation of a predetermined one of said first to third control valves, wherein said abnormality detecting means determines that operation of said first control valve is abnormal when said pressure within said part of said evaporative fuel-processing system upstream of said first control valve detected by said system internal pressure detecting means lowers by a predetermined amount or more while said controlled means is supplying said operation command signals for closing said first control valve, closing said third control valve and opening said second control valve.

11. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage;

a purging passage extending from said canister to said intake system of said engine;

a second control valve arranged across said purging passage;

a third control valve arranged at said air inlet port of said canister for establishing and interrupting communication between the interior of said canister and the atmosphere;

system internal pressure detecting means arranged at a location in a part of said evaporative fuel-processing system upstream of said first control valve for detecting pressure within said part of said evaporative fuel-processing system;

control means for supplying operation command signals to said first to third control valves for closing or opening the same; and abnormality detecting means responsive to an output from said system internal pressure detecting means and said operation command signals, for detecting an abnormality in operation of a predetermined one of said first to third control valves, wherein said abnormality detecting means determines that operation of said first control valve is abnormal when said pressure within said part of said evaporative fuel-processing system upstream of said first control valve detected by said system internal pressure detecting means rises above a predetermined value while said control means is supplying said operation command signals for opening said first control valve, opening said second control valve, and opening said third control valve.

12. An evaporative fuel-processing system for an internal combustion engine having an intake system, and a fuel tank, comprising:

a canister having an air inlet port provided therein;

an evaporative fuel-guiding passage extending from said fuel tank to said canister;

a first control valve arranged across said evaporative fuel-guiding passage;

a purging passage extending from said canister to said intake system of said engine;

a second control valve arranged across said purging passage;

a third control valve arranged at said air inlet port of said canister for establishing and interrupting communication between the interior of said canister and the atmosphere;

system internal pressure detecting means arranged at a location in a part of said evaporative fuel-processing system upstream of said first control valve for detecting pressure within said part of said evaporative fuel-processing system;

control means for supplying operation command signals to said first to third control valves for closing or opening the same; and abnormality detecting means responsive to an output from said system internal pressure detecting means and said operation command signals, for detecting an abnormality in operation of a predetermined one of said first to third control valves, wherein said abnormality detecting means determines that operation of said second control valve is abnormal when said pressure within said part of said evaporative fuel-processing system upstream of said first control valve detected by said system internal pressure detecting means lowers by a predetermined amount or more while said control means is supplying said operation command signals for opening said first control valve, closing said second control valve, and closing said third control valve.

* * * * *